US010070706B2

(12) United States Patent
Gobbato et al.

(10) Patent No.: US 10,070,706 B2
(45) Date of Patent: Sep. 11, 2018

(54) OPENABLE PENDANT FOR THE CONTAINMENT OF ASHES, FRAGRANCES, FLAVOURS AND/OR SIMILAR

(71) Applicant: M.P.M. DI GOBBATO ENZO-S.R.L., Vicenza (IT)

(72) Inventors: Lorenzo Gobbato, Camisano Vicentino (IT); Morena Gobbato, Camisano Vicentino (IT)

(73) Assignee: M.P.M DI GOBBATO ENZO—S.R.L., Vicenza (IT)

( * ) Notice: Subject to any disclaimer, the term of this patent is extended or adjusted under 35 U.S.C. 154(b) by 0 days.

(21) Appl. No.: 15/110,058

(22) PCT Filed: Mar. 16, 2015

(86) PCT No.: PCT/IB2015/051896
§ 371 (c)(1),
(2) Date: Jul. 6, 2016

(87) PCT Pub. No.: WO2015/140685
PCT Pub. Date: Sep. 24, 2015

(65) Prior Publication Data

US 2016/0324278 A1 Nov. 10, 2016

(30) Foreign Application Priority Data

Mar. 21, 2014 (IT) ..... PD2014A0066

(51) Int. Cl.
*A44C 25/00* (2006.01)
*A44C 15/00* (2006.01)

(52) U.S. Cl.
CPC ..... *A44C 25/004* (2013.01); *A44C 15/002* (2013.01); *A44C 25/002* (2013.01)

(58) Field of Classification Search
CPC ... A44C 25/001; A44C 25/002; A44C 25/004; A44C 15/003
(Continued)

(56) References Cited

U.S. PATENT DOCUMENTS 168,972 A * 10/1875 Dayton ..... A61L 9/12
128/207.14
418,218 A * 12/1889 Peabody ..... A44C 17/02
29/896.33
(Continued)

FOREIGN PATENT DOCUMENTS

FR 2719027 A1 10/1995

OTHER PUBLICATIONS

International Search Report for PCT/IB2015/051896 dated Jun. 24, 2015.
English Abstract of FR2719027A1 dated Oct. 27, 1995.

*Primary Examiner* — Emily M Morgan
(74) *Attorney, Agent, or Firm* — Abelman, Frayne & Schwab

(57) ABSTRACT

A pendant for containing a commemorative or aromatic object includes a first body having inner and outer surfaces, the inner surface being configured to house a second commemorative object or aromatic substance. A second body includes outer and inner surfaces and a plate. The inner surface and plate define a permanently enclosed chamber selectively sealed to retain the commemorative or aromatic object. The second body has an opening with a removable cover for receiving the commemorative or aromatic object in the chamber. A rotatable coupler is provided between the first and second bodies to enable open and closed positions of the pendant. The second body includes a seal formed between the inner surface and the plate to define a portion of the chamber and to define an annular interspace isolating the
(Continued)

chamber from an external environment both in the closed and open positions of the pendant.

14 Claims, 4 Drawing Sheets

(58) Field of Classification Search
USPC ..... 63/1.14, 18, 19
See application file for complete search history.

(56) References Cited

U.S. PATENT DOCUMENTS

| | | | | | |
|---|---|---|---|---|---|
| 718,562 | A | * | 1/1903 | Blackinton | A44C 25/004 63/19 |
| 958,983 | A | * | 5/1910 | Wakefield | A44C 25/004 220/DIG. 26 |
| 2,863,307 | A | * | 12/1958 | Donle | A44C 25/004 63/19 |
| 3,618,338 | A | * | 11/1971 | Sauer | A44C 25/004 220/315 |
| 5,078,484 | A | * | 1/1992 | Vaughn | A44C 1/00 351/158 |
| 5,651,274 | A | | 7/1997 | Taylor | |
| 5,713,147 | A | * | 2/1998 | Johnson | A47G 1/0616 40/734 |
| 5,755,116 | A | * | 5/1998 | Sparacino | A44C 5/003 63/1.14 |
| 5,950,287 | A | * | 9/1999 | Cacciatore | A61G 17/08 27/1 |
| 6,557,375 | B1 | | 5/2003 | Simmons et al. | |

* cited by examiner

OPENABLE PENDANT FOR THE CONTAINMENT OF ASHES, FRAGRANCES, FLAVOURS AND/OR SIMILAR

The present invention relates to an improved openable pendant (also commonly known as charm) suitable to be combined with chains, necklaces, bangles, bracelets or earrings for jewelry, goldsmith and/or costume jewelry and intended to contain ashes, fragrances, flavours, essences and/or similar symbolic and/or emotional substances introduced in the form of powder, liquid or small particles of materials that evoke a memory—such as the sand of a desert or a beach of a seaside resort—.

As known, goldsmith, jewelry, costume jewelry and/or the like wearable by people are always produced according to countless styles, shapes, combinations of lines, colours and, more generally, according to the most varied aesthetic effects.

In the field of jewelry, goldsmith, costume jewelry and/or the like openable pendants (for example, photograph holders) are dearly distinguishable and identifiable, usually of shape reduced compared to a traditional table holders and typically adapted to be coupled with a necklace, a chain, a bracelet or an earring in order to constitute a classic pendant in which at least one small picture that reminds a person, a place, a happened event and so on of particularly personal relevance is to be housed.

Even within the category of the openable pendants versions available on the market are several and varied not only on the basis of the type of metallic material, typically although not exclusively precious, which they are produced with, but also on the basis of the aesthetic effects or ornamental patterns defined on the outer surface of at least one of the half portions (or shaped bodies) equal each other by profile forming the openable pendants herewith concerned.

As also widely known, the aforesaid shaped bodies of any openable pendant of the current state of the technique are rotatably coupled together by means of constraint means (or hinge means) in order to define for the openable pendant itself a closed position, in which it presents the minimum overall dimensions and the inner surfaces of the two shaped bodies are hidden and arranged one facing the other, and at least one opened position in which the inner surfaces of the shaped bodies are directed towards the outside and, therefore, at least partially in sight.

A construction type rather of niche of openable pendants, currently commercially available and increasingly requested by the customers of the field, involves the introduction and containment in a proper inner chamber of the jewel of a minimum quantity of powder particles—such as the ashes resulting from the cremation of a loved deceased person or a animal, the soil of a particular holiday resort or even flower essences—or liquid substance—such as a perfume or an essential oil—.

This, in addition to the traditional miniaturized photo or image contained preferably into an openable pendant, gives the jewel concerned further affective and emotional valence, evocative of a person, an animal or a special place which the person wearing or otherwise holding the openable pendant is particularly fond of up to the point of trying to always take a concrete and real memory thereof with him or her.

Typically, from a constructive point of view, an openable pendant for the containment of ashes, fragrances, flavours and/or similar of the known type comprises a first shaped body provided with an outer surface that remains in sight in any condition of use of the pendant and an inner surface which firmly houses a photo, a picture, a drawing and/or the like, as well as a second shaped body, in turn provided with an outer surface that remains in sight in any condition of use of the pendant and in which an inner chamber is defined which firmly houses a symbolic, commemorative, fragrant and/or aromatic substance adapted to be introduced into the inner chamber itself through a through coupling hole made in the second shaped body.

A known openable pendant for the containment of ash, fragrances, flavours and/or similar also includes constraint means which rotatably couple together the first and the second shaped body in such a way as to define for the openable pendant at least a closed position and an opened position which have been previously mentioned and closure means, removably coupled with the second shaped body at the through coupling hole in such a way as to tightly close the inner chamber.

In this way, the openable pendant is actually filled with a small but significant, at least from an emotional and symbolic point of view, desired quantity of substance or material that the person using the openable pendant itself always carries with him or her, drawing the emotional implications sought.

Patent document published as FR2719027 A1 concerns a typical powder compact for women, therefore, an item wearable in itself, by means of a bracelet, by a person but which is only exploited in order to allow access to its contents, namely the volatile consumable product, such as a perfume or a powder.

Such a prior art document highlights throughout that when the article is in the opened position, the product contained in one of the two bodies rotatably coupled each other and the inner chamber which houses it are, indeed, totally accessible to the person and in full contact with the outside: in essence the inner chamber is effectively closed only when the item is in the closed position, lacking any closure system of the inner chamber itself when the item is in the opened position (and it could not be otherwise since at that point the substance contained inside such an inner chamber would not be exploitable at all by the person and the item would lose the reason for which it was designed).

Moreover, in general, in FR2719027 A1, the seal gasket, placed on an annular edge surrounding the inner housing chamber of the product, performs its function only in the closed position of the item.

In any case, the openable pendants as currently conceived in the prior art have some recognized drawbacks.

In particular, the main drawback of the openable pendants of the prior art intended for the specific use described above—containment of ash, fragrances, flavours and/or similar—is represented by the fact that, notwithstanding the closure means, the powdery or liquid substance present into the closed inner chamber made in one of the two shaped bodies inconveniently enters in contact with the external environment, according to a two-way communication, and that at the constraint means which the two shaped bodies are coupled together with.

This depending on the fact that the constraint means are an assembly distinct from the shaped bodies that they must join, with which are stably coupled by means of junction systems such as welding with material addition.

Indeed, on one hand the constraint means constitute the way for the accidental leakage of the substance from the inner chamber, especially when the openable pendant is handled or otherwise used, for example combined as a pendant to a necklace, on the other hand, the constraint means constitute the way for the accidental entry into the inner chamber of extraneous external agents, such as typically moisture or liquids of various nature, that impact in a negative way on the state of preservation of the substance contained into it with which they inevitably come in contact.

This situation generates a double drawback, such as first of all the need of restoring over time the content of the original substance into the inner chamber at least to prevent its definitive decomposition, exhalation or dissolution, and secondarily (but only in order of list) the onset in the user of a mood not exactly positive though not often of full discouragement.

Starting, therefore, from the knowledge of the above drawbacks of the prior art, the present invention intends to give them complete remedy.

Particularly, main purpose of the present invention is to provide an improved openable pendant for the containment of ashes, fragrances, flavours and/or similar able to keep with extreme effectiveness, and in any case better than the known art, the conservation state of these substances or objects while they are into the inner chamber of the shaped body concerned, avoiding, or at least drastically reducing compared to the equivalent known art, the risk of their casual, even if only partial but constant in time, contact with the external environment.

Within such a purpose, it is task of the present invention to devise an openable pendant for the containment of ashes, fragrances, flavours and/or similar which allows to avoid contamination by external agents or dispersions outside of these substances, which can be typically found, instead, in equivalent pendants of the prior art.

Another task of the invention is to make available an improved openable pendant for the containment of ashes, fragrances, flavours and/or similar that, compared to the prior art, allows to reduce the need of even only partial restoration interventions of the quantity of these substances that the user wishes it is contained into the inner chamber of the related shaped body.

It is a further task of the present invention to indicate an improved openable pendant for the containment of ashes, fragrances, flavours and/or similar which ensures the end user a positive constant feeling of full enjoyment of the emotional, affective and/or symbolic value he attributes to these substances, avoiding the onset in the user himself of moods of sadness, discouragement, disappointment, if not deep sorrow for their dissolution or even only partial deterioration.

A last but not least purpose of the invention is to create an improved openable pendant for the containment of ashes, fragrances, flavours and/or similar that reaches these technical effects without impacting negatively on its aesthetic quality.

Said purposes are achieved through an improved openable pendant for the containment of ashes, fragrances, flavours and/or similar according to claim 1 attached hereto, as hereinafter referred for the sake of exposure brevity o.

Further technical and constructive features of detail of the improved openable pendant of invention are contained in the corresponding dependent claims.

The abovementioned claims, specifically and concretely defined in the following, are integral part of the present description.

Advantageously, the improved openable pendant for the containment of ashes, fragrances, flavours and/or similar of the invention prevents these substances from communicating with the external environment in any manner and especially in any position—closed or even only partly opened—taken by the openable pendant itself, thus allowing to keep constant their quantity and intact and/or uncontaminated their status of integrity, whether it is dusty, liquid or particle.

This is a consequence of the fact that, in the invention, the closed inner chamber in which one or more of these substances are contained, thanks, from one side, to the closure means and, on the other side, to the innovative sealing means which it is provided with, is separated and isolated from the constraint means in any use condition of the openable pendant of the invention: as mentioned, in similar openable pendants of the prior art are the constraint means are a source of problems since they constitute the ideal vehicle for the harmful and unwanted bidirectional communication between the external environment and the aforesaid inner chamber and the resulting dispersion or contamination of the substance contained into it.

Still advantageously, in substance, ashes, perfumes, flavours and/or similar contained into the inner chamber of the improved openable pendant of the invention (inner chamber that, it is confirmed, is closed in any position of the latter) are largely preserved by their accidental contact with the external environment, to all the evident advantage of their actual, complete and effective state of preservation which reflects in a full satisfaction of the end user both in practical terms and emotional terms.

Equally advantageously, the improved openable pendant for the containment of ashes, fragrances, flavours and/or similar that is the object of the invention has an aesthetic impact for nothing biased by improvements of technical nature which have just been partly indicated, and mainly represented by the sealing means, since the latter are hidden from view in any use condition of the openable pendant, being contained into one of the two shaped bodies that make up the openable pendant itself.

The purposes and advantages described above, as well as others that will emerge below, will appear to a greater extent from the detailed description which follows, relating to a preferred embodiment of the improved openable pendant for the containment of ashes, fragrances, flavours and/or similar of the invention, given by indicative and illustrative, but not limitative, way with reference to the accompanying drawings, in which.

The improved openable pendant (or charm) object of the invention, consisting for example of a photographs holder and properly intended to contain ashes, fragrances, flavours and/or similar, is illustrated in four different assonometric views, which also highlight two distinct positions of use thereof, in FIGS. 1-4 where it is globally numbered with 1.

Figure 1:
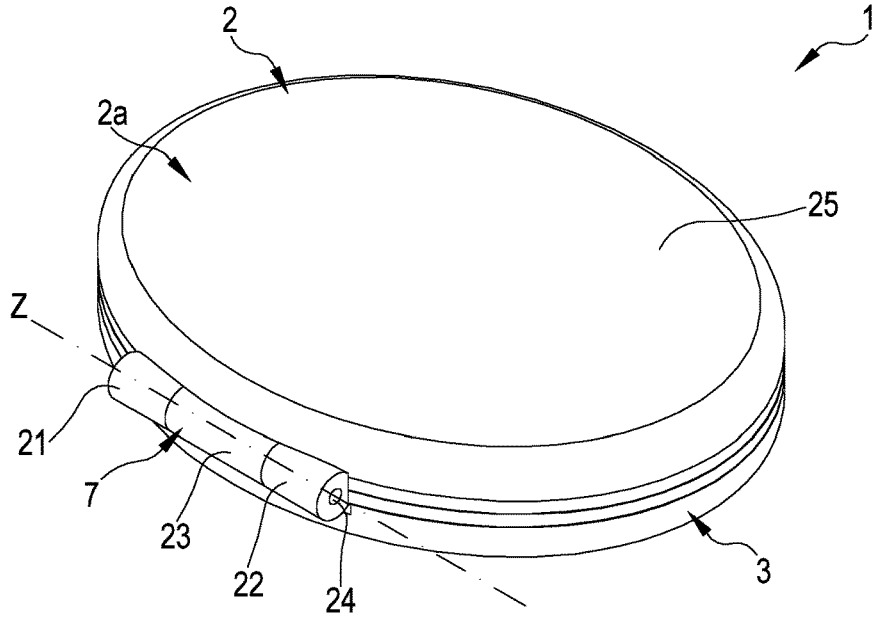
FIGS. 1 and 2 are two different assonometric views of the improved openable pendant of the invention in the closed position.
Figure 2:
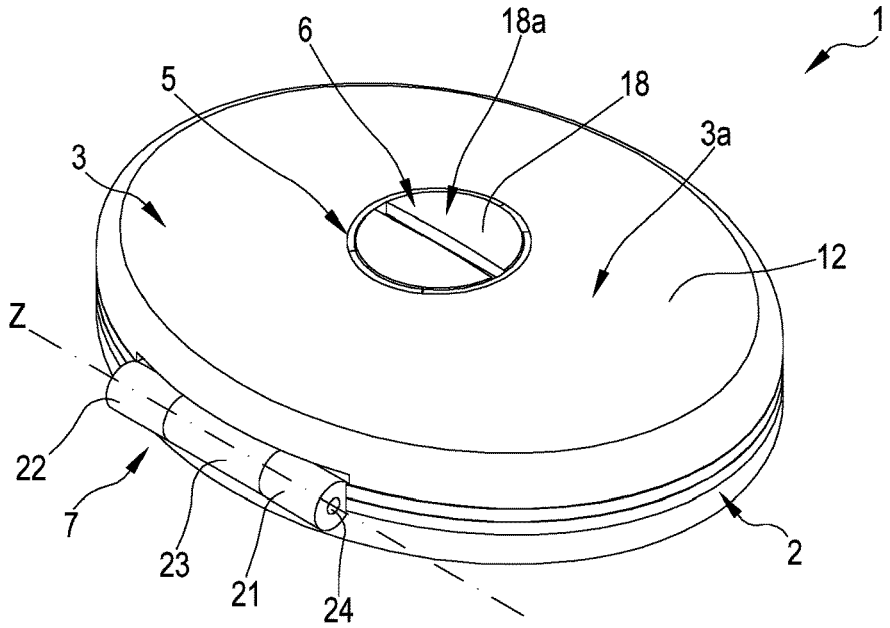
Figure 3:
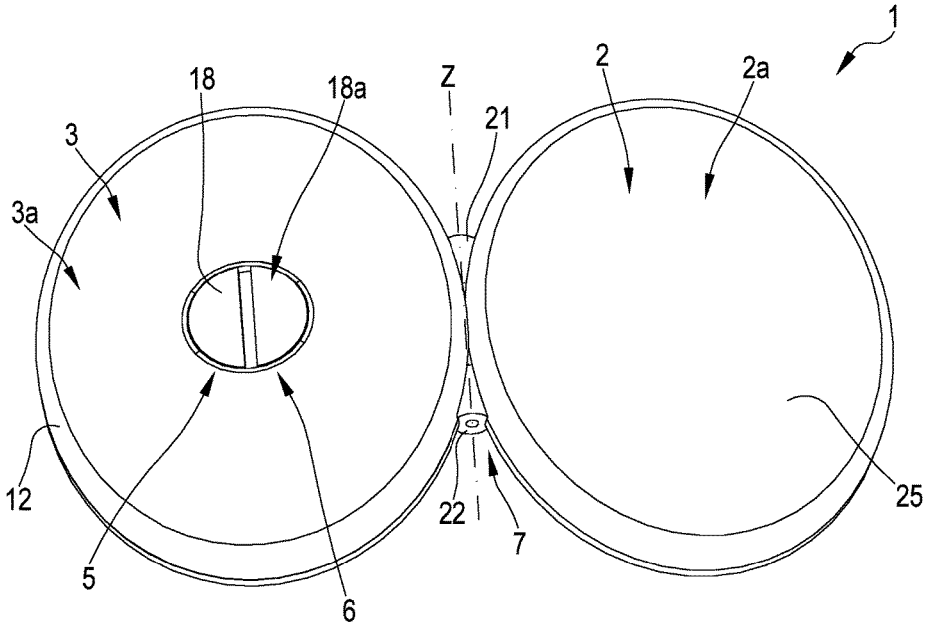
FIGS. 3 and 4 are two different assonometric views of the improved openable pendant of the invention in the opened position.
Figure 4:
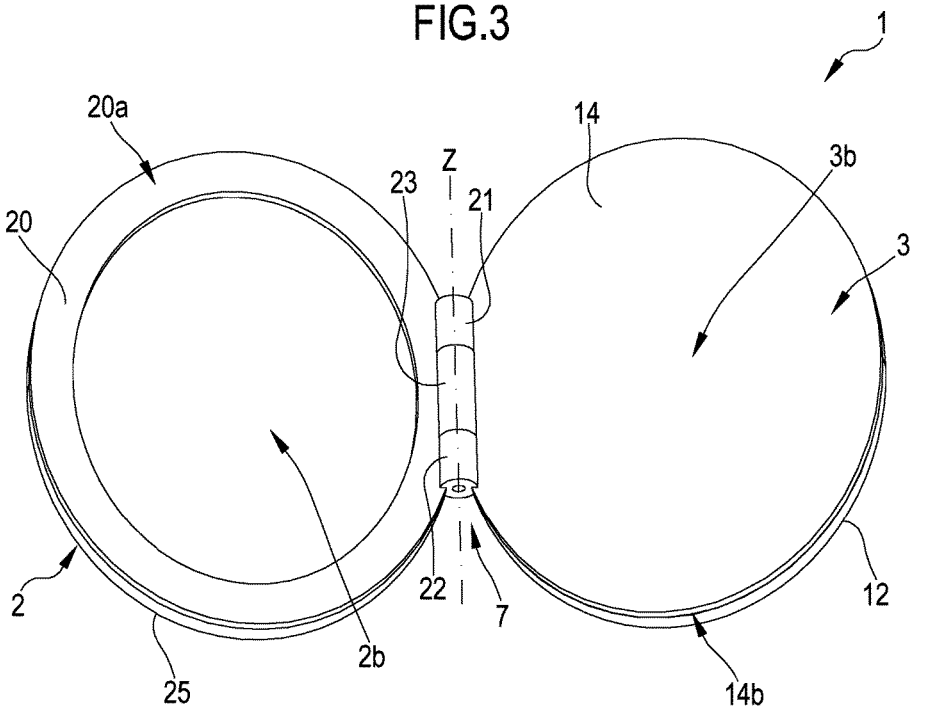
Figure 7:
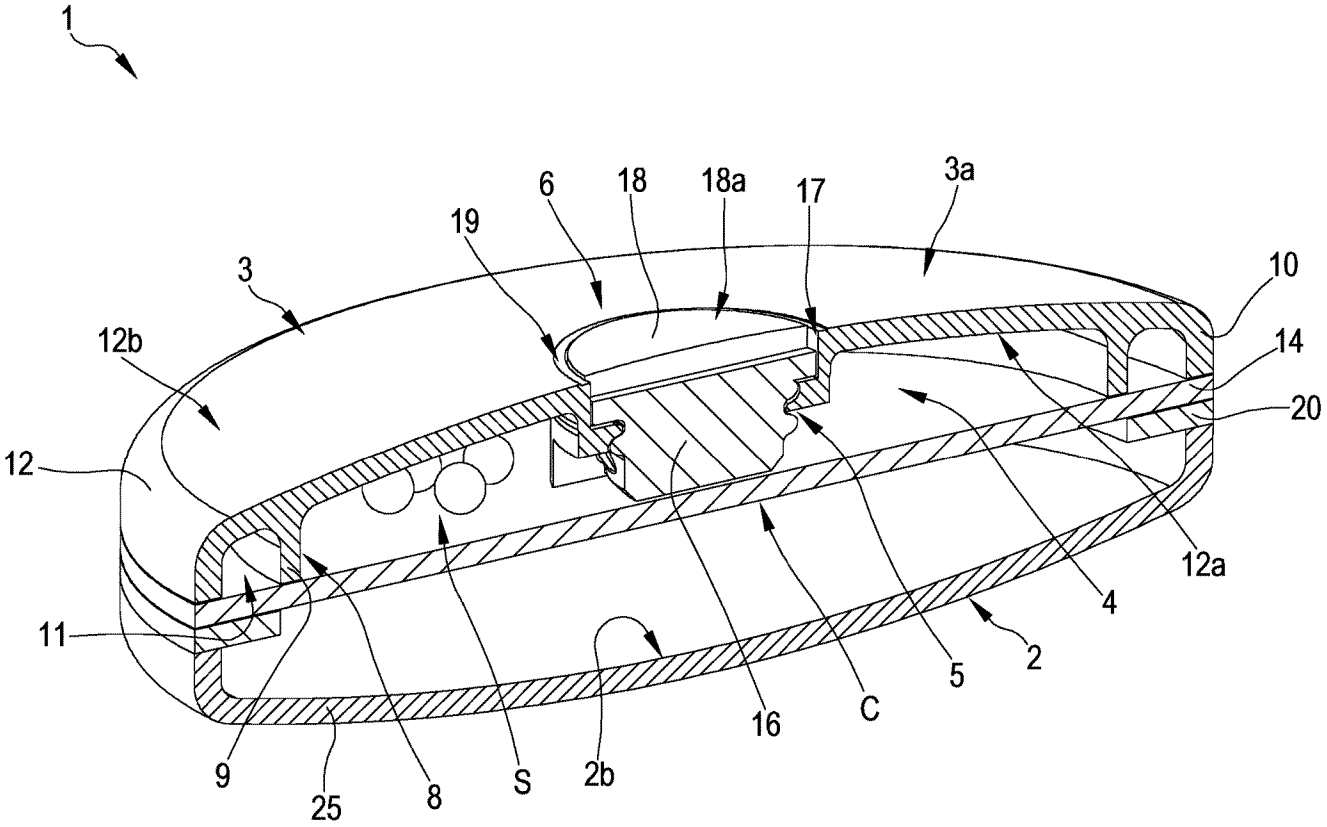
FIG. 7 is an assonometric view of the improved openable pendant of FIG. 2 according to a cross-sectional plane.

As it can be seen, the improved openable pendant 1 includes:

- a first shaped body 2 provided with an outer surface 2*a*, suitable to remain in sight in any condition of use of the openable pendant 1, and with an inner surface 2*b* designed to stably house a photo, a picture, a drawing, a portrait, a watch, a written paper such as a poem, a prayer, an aphorism, a maxim or a proverb, and/or the like;

a second shaped body 3 provided with an outer surface 3*a* adapted to remain in sight in any condition of use of the openable pendant 1 and in which an inner chamber 4 is defined designed to stably house a symbolic, commemorative, fragrant and/or aromatic substance, visible in FIG. 7 where it is indicated with S, and a through coupling hole 5 through which the symbolic, commemorative, fragrant and/or aromatic substance S is adapted to be introduced into the inner chamber 4 itself;

constraint means, as a whole numbered with 7, which rotatably couple together the first shaped body 2 and the second shaped body 3 in such a way as to define for the openable pendant 1 a closed position—shown in FIGS. 1 and 2—, in which the inner surface 2*b* of the first shaped body 2 is facing and substantially close to the inner surface 3*b* of the second shaped body 3, and at least an opened position—shown in FIGS. 3 and 4—in which the inner surface 2*b* of the first shaped body 2 and the inner surface 3*b* of the second shaped body 3 are in sight and facing outwardly;

closure means, overall indicated with 6, removably coupled with the second shaped body 3 at the through coupling hole 5 in such a way as to tightly close the inner chamber 4 both in the closed position and in the opened position of the openable pendant 1.

In accordance with the invention, the improved openable pendant 1 comprises sealing means, generally indicated with 8, placed inside the inner chamber 4 in such a way as to physically separate it from the constraint means 7 and isolate the inner chamber 4 itself from the external environment both in the closed position and in the opened of the openable pendent 1 in order to prevent dispersion outside, through the constraint means 7 themselves, of the symbolic, commemorative, fragrant and/or aromatic substance S or entry into the inner chamber 4, always through the constraint means 7, of external extraneous impurities that inevitably contaminate the symbolic, commemorative, fragrant and/or aromatic substance S.

Preferably but not necessarily, as it can be better obtained from FIG. 7, the sealing means 8 are in this case of constructive type and include an inner annular edge 9 spaced apart from the folded peripheral edge 10 of the second shaped body 3 and interposed between the center C and such folded peripheral edge 10 of the second shaped body 3 in such a way as to define an annular isolation interspace 11 separating the inner chamber 4 from the above constraint means 7.

Other embodiments of the openable pendant of the invention, not shown in the drawings that follow, could provide that the sealing means are of another type, while remaining placed inside the inner chamber of the second shaped body and being for example of the assembled type and comprising an annular gasket or a proper sealing filler material which forms an annular edge.

Figure 6:
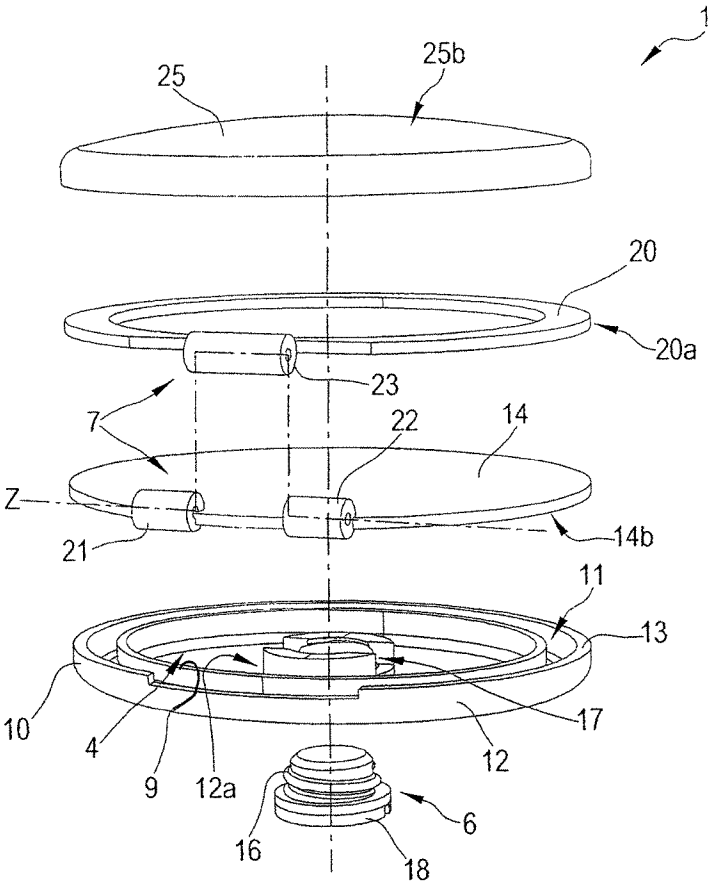
FIGS. 5 and 6 are two distinct exploded assonometric views of the improved openable pendant of the invention.
Figure 5:
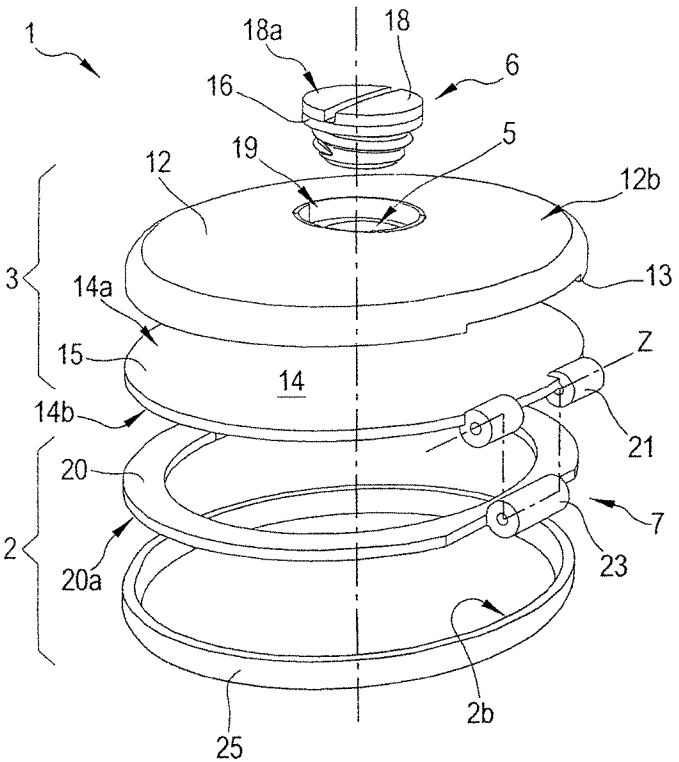

As illustrated in FIGS. 5-7, for purely preferential and, therefore, not binding title, the second shaped body 3 comprises a main element 12 provided with a folded perimetrical edge 13 and a laminar plate 14 coupled with the main element 12 by means of first junction means, for the sake of simplicity not shown in the figures that follow, applied at the folded perimetrical edge 13 of the main element 11 and at the perimetrical portion 15 of the laminar plate 14.

In the specific case, the inner annular edge 9 of the sealing means 8 is realized in a single body with the main element 12, protrudes from the inner wall 12*a* of the main element 12 and is coupled with a first side face 14*a* of the laminar plate 14 through second junction means, still not shown in the figures that follow for the sake of simplicity.

It is understood that in other embodiments of the improved openable pendant of the invention, not represented, the inner annular edge of the sealing means could be realized in a single body with the laminar plate, protrude from the first side face of the latter and be coupled with the inner wall of the main element through the second junction means.

FIGS. 5-7, also, show that the through coupling hole 5 is made in the main element 12, in which case at least the outer wall 12*b* of the main element 12 is in sight in every condition of use of the improved openable pendant 1 of the invention and the laminar plate 14 is hidden from view in the closed position of the openable pendant 1.

Alternatively, the through coupling hole could be made in the laminar plate, in which case at least a first side face of the laminar plate could be in sight in every conditions of use of the improved openable pendant of the invention and the main element could be hidden from view in the closed position of the openable pendant itself.

Preferably, the first junction means comprise a welding with filler material, formed as a continuous cord, applied around the entire perimeter of the folded perimetrical edge 13 of the main element 12 and around the entire perimeter of the perimetrical portion 15 of the laminar plate 14.

Always in preferred, but not exclusive, way, the second junction means are of the same type of the first junction means with respect to which are applied simultaneously or seamlessly during the coupling step of the laminar plate 14 to the main element 12.

As regards the closure means 6 firstly introduced, operative both in the closed position and in the opened position of the openable pendant 1, FIGS. 2, 3 and 5-7 show that they include a screw 16 engaging in a nut screw 17 made in the entire longitudinal portion which the through coupling hole 5 develops along: particularly although not necessarily, the screw 16 is provided with an operating head 18 housed in an annular seat 19 made in the outer surface 3*a* of the second shaped body 3 and coaxial to the nut screw 17 which constitutes the through hole 5.

More in detail, as it can be better dearly identified in FIGS. 2, 3 and 7, the upper surface 18*a* of the operating head 18 is coplanar with the outer surface 3*a* of the second shaped body 3 when the screw is fully meshed (or engaged) in the nut screw 17.

With reference to the constraint means 7, they are arranged protruding from the side edge 14*b* of the laminar plate 14 of the second shaped body 3, as well as from the side edge 20*a* of a laminar ring 20 belonging to the first shaped body 2.

In a preferred, but not necessary, manner, the constraint means 7 include a classic angular joint which, as shown by the FIGS. 1-6, in the specific case is, by way of pure example, composed by:

two tubular elements 21, 22 coaxially spaced apart each other by a predetermined light, arranged in the side edge 14*b* of said plate laminar 14;

a tubular fitting 23 arranged in the side edge 20*a* of said laminar ring 20 and contained into the predetermined light to be coaxially interposed between the tubular elements 21, 22;

an union join pin 24 inserted into the tubular elements 21, 22 and into the tubular fitting 23 and defining a linear rotation axis Z around which the user rotates the first shaped body 2 and/or the second shaped body 3 in order to have the improved openable pendant 1 of the invention between the closed position of FIGS. 1 and 2 and the opened position of FIGS. 3 and 4.

It remains understood that in other embodiments of the improved openable pendant of the invention, not yet represented in the accompanying drawings, the constraint means could include a number of tubular elements and a number of tubular fittings different from those ones just mentioned, such a number, for each of them, could vary at will and depending on the construction choices starting from one, as well known to the person skilled in the construction of such mechanical parts also in the field of jewelry, goldsmith and/or costume jewelry.

In particular, FIGS. 5 and 6 show that even the first shaped body 2 has a composite structure comprising, in addition to the aforesaid laminar ring 20, a main counter-element 25 coupled with the laminar ring 20 through third junction means, not illustrated for the sake of simplicity but of the same type of the first and second junction means before described.

Such a main counter-element 25 properly presents a profile equal to the profile of the main element 12 of the second shaped body 3.

As it is apparent from the figures so far mentioned, both the main element 12 of the second shaped body 3 and the main counter-element 25 of the first shaped body 2 have a respective convex outer surface 12*b*, 25*b*, which gives the improved openable pendant of the invention a greater aesthetic pleasantness, and/or an internally hollow structure which, while it determines an increase in the size of the inner chamber 4, lightens the total weight of the jewel concerned.

Advantageously but not necessarily, the first shaped body 2 is provided in such a way as to already include a decorative shaped insert, not shown in the attached figures and usually having a profile substantially equal to that one of the first shaped body 2 itself, placed close to the inner surface 2*b* of the latter to which is firmly fixed by a removable protection, also not represented for the sake of convenience and made of transparent material, for example PMMA.

The removable protection is applied superiorly to such decorative shaped insert in order to allow, on one hand, the view of the photo, image, drawing, portrait, dock, written paper and/or the like which is interposed between the decorative shaped insert and the removable protection cover itself and, on the other hand, the simple visual appreciation of the shaped decorative insert if the first shaped body 2 presents one or more through incisions made according to a given ornamental pattern.

Operatively, the user (for example a shopkeeper but more likely the end user who buys and even daily uses the jewel concerned) loosens the screw 16 and decouples it from the nut screw 17, thus freeing the through coupling hole 5 present in this case in the main element 12 of the second shaped body 3.

Subsequently, through such a through coupling hole 5 the user introduces a predefined amount of the desired substance S (ashes arising from the cremation of a loved extinct person or a dead animal, or a fragrance, an aroma and so on) into the inner chamber 4 of the second shaped body 3 (provided that the main element 12 and the laminar plate 14 that compose it are already stably coupled each other by the first and second junction means, in such a way as to close the inner chamber 4, and that the second shaped element 3 is already stably coupled with the first shaped body 2 by the constraint means 7).

As soon as the operation of introduction of the symbolic, commemorative, fragrant and/or aromatic substance S into the closed inner chamber 4 has been completed, the user tightly closes the through coupling hole 5 by engaging again the screw 16 in the nut screw 17 up to make the upper surface 18*a* of the operating head 18 coplanar with the outer surface 3*a* of the second shaped body 3.

The presence of the sealing means 8 inside the inner chamber 4, in this case in the form of the inner annular edge 9 and the resulting annular isolation interspace 11 formed between the center C and the folded peripheral edge 10 of the second shaped body 3, ensures the effective preservation of the substance S in such an inner chamber 4, advantageously avoiding its contact with the constraint means 7 and, in return, with the external environment.

On the basis of the description just provided, it is understood, therefore, that the improved openable pendant for the containment of ashes, fragrances, flavours and/or similar of the present invention achieves the purposes and reaches the advantages previously mentioned. Unlike the known art constituted for example by FR2719027 A1, therefore, the openable pendant of the invention is able to totally preserve the integrity of the symbolic, commemorative, fragrant and/or aromatic substance (introduced into the inner chamber of one of the component shaped bodies) in any utilization condition of the object, not only when it is in the closed position but also when it is in the opened position: this thanks to the fact that, in the invention, the inner chamber always remains hermetically closed in every position taken by the openable pendant and to the fact that, in an innovative manner, the sealing means physically separate the inner chamber from the constraint means permanently isolating it from the external environment in the closed position and in the opened position of the object, so that the substance provided in such an inner chamber can be accessed only by recklessly and thoughtlessly breaking the shaped body in which the inner chamber is made.

Upon implementation, changes could be made to the improved openable pendant of the present invention consisting, for example, in closure means applied at the through coupling hole to close the inner chamber of type different from that one previously described and shown in the accompanying figures.

Beyond to this, further embodiments, not shown, could exist in which the improved openable pendant exclusively claimed herewith includes constraint means different from those ones shown in the drawings that follow, which does not affect the advantage brought by the present invention.

In addition, in further embodiments of the improved openable pendant of the invention, not illustrated, the inner chamber of the second shaped body could contain more than one symbolic, commemorative, fragrant and/or aromatic substance able to excite an emotion and/or a memory in the end user.

Furthermore, other embodiments of the improved openable pendant of the invention, here still not accompanied by reference drawings, could provide sealing means different from those ones described above and shown in the accompanying figures.

It should be noted that the shaped bodies belonging to the improved openable pendant of the invention could be implemented in any metallic material, such as steel or metal of adequate mechanical strength (e.g., titanium) or, even more, such as any of the precious metals selected from the group consisting of gold, silver, palladium and platinum or in any plastic material of adequate mechanical strength and pleasant aesthetic effect.

It should be also noted that the improved openable pendant of the invention could take any profile different from than one shown in the following figures and dependent on market demands and customers' tastes: just to cite a further embodiment, not shown, of the openable pendant of the present invention, it could present a profile in the shape of the heart, in which case its component elements—such as, for example, the main element and the laminar plate of the first shaped body and the laminar ring and the main counter-element of the second shaped body described above—will present same profile.

It is, finally, clear that several other changes could be made to the improved openable pendant concerned, without departing from the principle of novelty intrinsic in the inventive idea expressed herein, as it is clear that, in the practical implementation of the invention, materials, shapes and sizes of the illustrated details could be changed, as needed, and replaced with others technically equivalent.

Where the constructive features and techniques mentioned in the following claims are followed by reference numbers or signs, those reference signs have been introduced with the sole objective of increasing the intelligibility of the claims themselves and therefore they have no limiting effect on the interpretation of each element identified, by way of example only, by these reference signs.

The invention claimed is:

1. An openable pendant (1) for the containment of at least one of a commemorative substance or object comprising:

a first shaped body (2) including a main counter-element (25) and a laminar ring (20), the main counter-element (25) having a first outer surface (2*a*) and a first inner surface (2*b*), the first inner surface being configured to house a first commemorative substance or object, and the laminar ring (20) disposed over the first inner surface and affixed to a periphery of the main counter-element;

a second shaped body (3) including a main element (12) and a laminar plate (14), the main element (12) having a second outer surface (3*a*) and a second inner surface (3*b*), the laminar plate (14) being affixed to the main element (12) and being positioned over the second inner surface in a spaced-apart and stationary arrangement to define an inner chamber (4) therebetween, the inner chamber being configured with a seal (8) to define an enclosed inner chamber to retain a second commemorative substance or object;

at least one coupler (7) configured to:

rotate said first shaped body (2) and second shaped body (3) to a closed position in which said first inner surface (2*b*) of said first shaped body (2) is facing to and is substantially parallel and close with respect to said laminar plate (14) of the second shaped body (3), and rotate said first shaped body (2) and said second shaped body (3) to an open position of said pendant in which said first inner surface (2*b*) of said first shaped body (2) and said laminar plate (14) of the second shaped body (3) are angled apart from each other;

wherein said second shaped body (3) includes a peripheral edge extending in a direction towards the first inner surface of the first shaped body (2) in the closed position of the pendant, the seal (8) having a perimeter and provided between and fixedly contacting both the second inner surface and the laminar plate of the second shaped body to define said enclosed inner chamber (4), said peripheral edge of the second shaped body circumscribing said seal (8) to define an annular interspace (11) between the seal perimeter and the peripheral edge of the second shaped body, the interspace separating and isolating said enclosed inner chamber (4) from an external environment both in said closed position and in said opened position of said openable pendant;

the second shaped body having a through-hole (5) configured to provide access and selectively receive said second commemorative substance or object into said enclosed inner chamber (4); and a cover (6) detachably coupled with said through-hole (5) to selectively provide access into and close said enclosed inner chamber (4).

2. The openable pendant (1) according to claim 1, wherein said seal perimeter is defined by an inner annular edge (9) interposed between a center portion of said second shaped body (3) and said peripheral edge of said second shaped body (3).

3. The openable pendant (1) according to claim 2, wherein the inner annular edge (9) protrudes from said second inner surface and is coupled with a first side face (14*a*) of said laminar plate (14).

4. The openable pendant (1) according to claim 2, wherein the second outer surface (3*a*) of said main element (12) of said second shaped body is visible in each opened and closed state of use of said openable pendant (1), and said laminar plate (14) is hidden from sight in said closed position of said openable pendant (1).

5. The openable pendant (1) according to claim 3, wherein a first weld is provided between an entire perimeter of said peripheral edge of said second shaped body and an entire perimeter of said laminar plate (14).

6. The openable pendant (1) according to claim 5, wherein said inner annular edge (9) protruding from an inner wall (12*a*) of said main element (12) is directly attached to a first side face (14*a*) of said laminar plate (14) by a second weld.

7. The openable pendant (1) according to claim 1 wherein said cover (6) comprise a threaded fastener (16) which:

engages threads (17) provided in at least a portion of said through-hole (5); said threaded fastener (16) having an operating head (18) configured to be received on an annular seat (19) formed in the second outer surface (3*a*) of said second shaped body (3) and coaxial to said threads (17) in said through-hole (5).

8. The openable pendant (1) according to claim 7, wherein an upper surface (18*a*) of said operating head (18) is coplanar to said second outer surface (3*a*) of said second shaped body (3) when said threaded fastener (16) is fully seated on the annular seat.

9. The openable pendant (1) according to claim 2, wherein said at least one coupler (7) is arranged to protrude from a side edge (14*b*) of said laminar plate (14) of said second shaped body (3) and from a side edge (20*a*) of the laminar ring (20) of said first shaped body (2).

10. The openable pendant (1) according to claim 9, wherein said at least one coupler (7) includes a rotatable hinge comprising:

at least one tubular element (21, 22) arranged in a side edge (14*b*) of said laminar plate (14);

at least one tubular fitting (23) arranged in a side edge (20*a*) of said laminar ring (20);

a union pin (24) inserted into said tubular element (21, 22) and into said at least one tubular fitting (23), wherein said union pin (24) defines a linear axis (Z) of rotation.

11. The openable pendant (1) according to claim 9, wherein said first shaped body (2) has a a profile equal to a profile of said second shaped body (3).

12. The openable pendant (1) according to claim 1, wherein the first commemorative object includes at least one of a photo, an image, a drawing, a portrait, a watch, or a written paper.

13. The openable pendant (1) according to claim 1, wherein the enclosed inner chamber (4) is configured to retain an aromatic substance.

14. The openable pendant (1) according to claim 1, wherein the enclosed inner chamber (4) is configured to retain ashes.

* * * * *